United States Patent [19]

Harmon

[11] 4,087,035

[45] May 2, 1978

[54] ATTACHMENT FOR STAPLING GUN

[76] Inventor: Everette Harmon, 8505 S. Miller, Oklahoma City, Okla. 73159

[21] Appl. No.: 748,706

[22] Filed: Dec. 8, 1976

[51] Int. Cl.[2] ..... B25C 7/00

[52] U.S. Cl. ..... 227/120; 227/123; 227/156

[58] Field of Search ..... 227/120, 123, 125, 126, 227/127, 128, 130, 133, 151, 156

[56] References Cited

U.S. PATENT DOCUMENTS

| | | | |
|---|---|---|---|
| 2,285,512 | 6/1942 | Harley | 227/132 |
| 2,618,779 | 11/1952 | Byard | 227/125 |
| 2,637,030 | 5/1953 | Wickman et al. | 227/120 |
| 2,668,290 | 2/1954 | Heller | 227/132 |
| 2,754,515 | 7/1956 | King | 227/132 |
| 3,215,324 | 11/1965 | Dorney | 227/127 |

*Primary Examiner*—Granville Y. Custer, Jr.
*Attorney, Agent, or Firm*—Robert M. Hessin

[57] ABSTRACT

An attachment for a stapling gun of the type which is used in the finishing and construction business for fastening electric cable and the like, and more particularly, the pneumatic stapler which is used for securing electrical cable through its routing within a building structure. The attachment consists of a guide member which is readily affixed to the commercially available staple gun to enable gun alignment and placement of the staple without danger of nicking or otherwise injuring the electrical cable insulation during placement and securing of the electrical cable as must be done in accordance with most building specification requirements.

1 Claim, 6 Drawing Figures

ATTACHMENT FOR STAPLING GUN

BACKGROUND OF THE INVENTION

1. Field of the Invention

The invention relates generally to structure for securing electrical cable in its intended placement throughout wooden framing and, more particularly, but not by way of limitation, it relates to an attachment enabling an improved stapling apparatus which has the capability of more rapid stapling operation with little or no danger of injury to the electrical cable insulation and sheathing.

2. Description of the Prior Art

The prior art is apparently devoid of attachment type structure for use with pneumatic stapling guns of the type wherein large staples, e.g., three-quarter inches wide and one to one and one-half inches in depth, are used in the building trade for various uses including affixure of metal lathe, shingling, crating and the like. Such staple guns find particular use in the building trade wherein electrical cable run throughout a building is stapled periodically to provide secure positioning, and commercially available staple guns do not provide the requisite alignment capability.

SUMMARY OF THE INVENTION

The present invention relates to a guide attachment which is readily affixable on the forward end of any of various commercially available pneumatic stapling guns. The guide attachment consists of a plate device which is readily attachable by means of the existing casing screws of the stapling unit to extend downward to the work area a guide foot which is essentially a bifurcated structure affording proper spacing between parallel guide points to allow easy and rapid positioning of the staple gun each time a staple is fired.

Therefore, it is an object of the present invention to provide a guide attachment for use with a powered stapling gun which will avoid certain problems inherent in nicking or cutting the outside insulation of electrical cable.

It is also an object of the present invention to provide a stapling gun which is faster in usage and will not harm such as ROMEX electrical cable during routing and lay down securing.

Finally, it is an object of the present invention to provide a stapling gun attachment which is both simple in form and economical in cost, and yet provides great savings in operational expense by eliminating the possibility of damage to cable product during installation.

Other objects and advantages of the invention will be evident from the following detailed description when read in conjunction with the accompanying drawings which illustrate the invention.

DETAILED DESCRIPTION OF THE INVENTION

Figure 1:
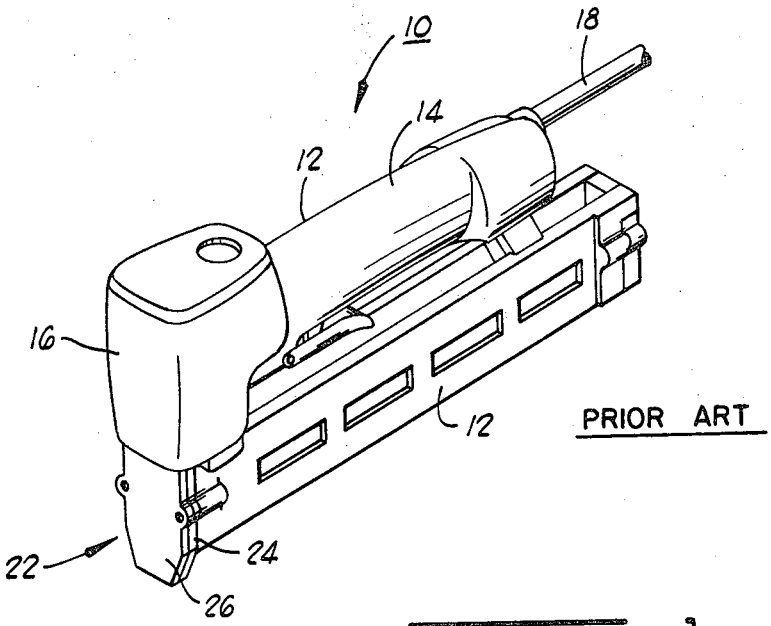
FIG. 1 (prior art) is a view in perspective of one form of commercially available stapling gun.

FIG. 1 illustrates one form of commercially available pneumatic stapling gun 10 which may be used in connection with the present invention. The particularly illustrated stapling gun 10 is a BOSTITCH Model T34 which is manufactured by the BOSTITCH Division of Textron, Inc., East Greenwich, R.I. While the invention is illustrated with respect to the particular stapling gun 10 of FIG. 1, other competitive models of stapling gun can utilize the present guide attachment in like manner, it being only necessary to relocate the fastening holes, as will be further described below.

Figure 2:
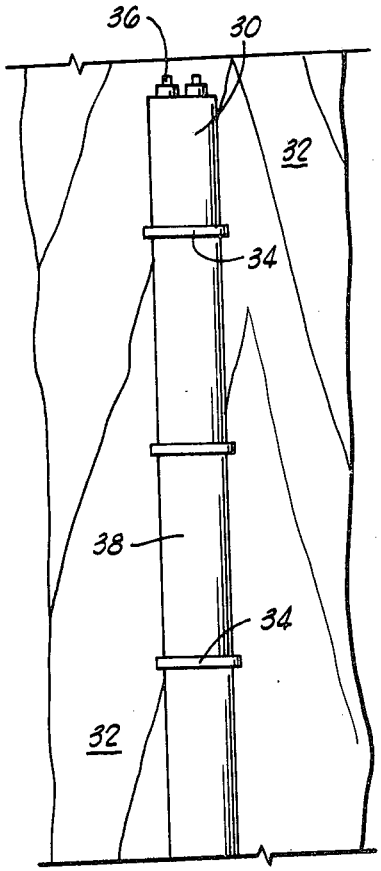
FIG. 2 is a depiction of the manner in which electrical cable or the like is stapled to a framing surface.

The stapling gun 10 consists of a frame assembly 12 which includes both a handle portion 14 and body housing 16. Pneumatic operating power is supplied by an air supply inlet hose 18. A staple magazine is secured lengthways beneath handle 14 to supply continual staple positioning for function with the driver head assembly 22 which operates in well-known manner with a wearplate 24 and nose plate 26 which houses the vertically driven staple driver (not shown). FIG. 2 illustrates the manner in which the stapling gun 10 fastens cable or the like to a receiving surface. In this case, a ROMEX cable 30 is secured to a wooden framing member 32 by means of a plurality of spaced staples 34. This is now a standard procedure for electric conduit securing in most areas of the United States.

Any of the standard forms of heavy duty staples may be utilized, e.g., one inch to one and one-half inch metal staples having five-eighths inch inside width. This type of staple and stapling gun 10 may be used for securing any of the ROMEX cable sizes, e.g., 10–2, 12–2, 12–3, etc., during electrical system installation. The ROMEX cable 30, as shown, is a 10–2 type having two conductors 36, inside packing material, and an outer sheath 38 of durable plastic. In prior installing techniques using such as stapling gun 10, there is alway great danger that staples 34 might nick or injure the outer plastic sheath 38 during placement, and the present invention provides a rapid alignment of the stapling gun 10 relative to cable 30 for stapling operation while eliminating danger of damage to the cable.

Figure 3:
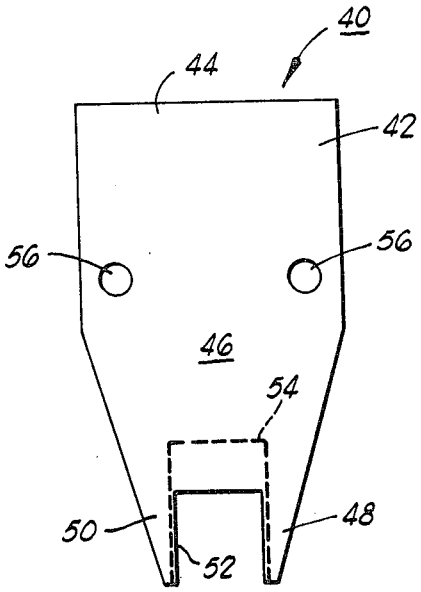
FIG. 3 is a plan view of one form of guide shoe attachment constructed in accordance with the present invention.

FIG. 3 illustrates a guide attachment 40, which is particularly adapted for use with stapling gun 10 of the BOSTITCH Type 34. Guide attachment 40 consists of a plate 42, thickness not being important but present designs are 5/32 inches thick. Plate 42 is formed with a square upper protion 44 having its fourth side extended into an equilateral, bifurcated guide point 46. Guide point 46 extends to two bifurcated tips 48 and 50 which define a cable guide way 52 of essentially square configuration. Cable guide way 52 is sized to receive the electrical cable therein during stapling operation so that the downward thrust of the staple is assured of continuing out of possible contact with the sides of cable sheath 38. The dash lines 54 indicate the staple disposition immediately behind the guide attachment 40 during the drive thrust of stapling gun 10.

Figure 4:
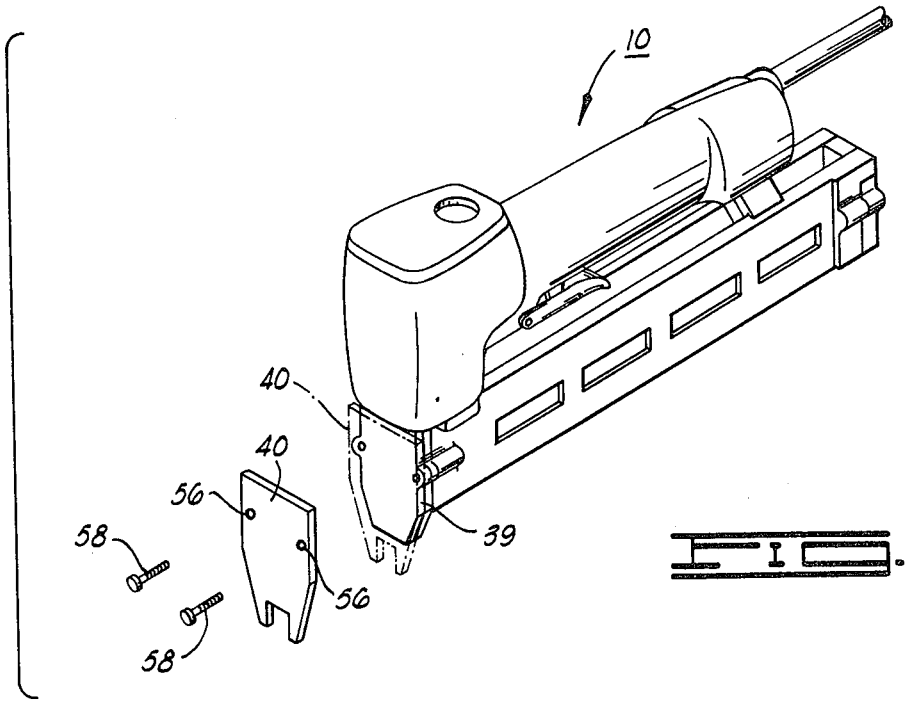
FIG. 4 is a perspective view with partially exploded parts showing the manner in which the guide shoe attachment may be integrally assembled with the stapling gun.

FIG. 4 illustrates the stapling gun 10 and guide attachment 40 as it is secured in operative attachment. Holes 56 are disposed through guide attachment 40 for mating engagement via fasteners 58 so that guide attachment 40 is in operative alignment forward and adjacent to nose plate 39 of stapling gun 10. While the guide attachment 40 may vary in shape for most aesthetic appeal relative to the type of stapling gun 10 utilized in conjunction therewith, the guide holes 56 may also vary in size and disposition in accordance with the counterpart combinative stapling gun 10. It should be understood then, that such basic guide attachment 40 can be utilized with any of the commercially available pneumatic stapling guns.

Figure 5:
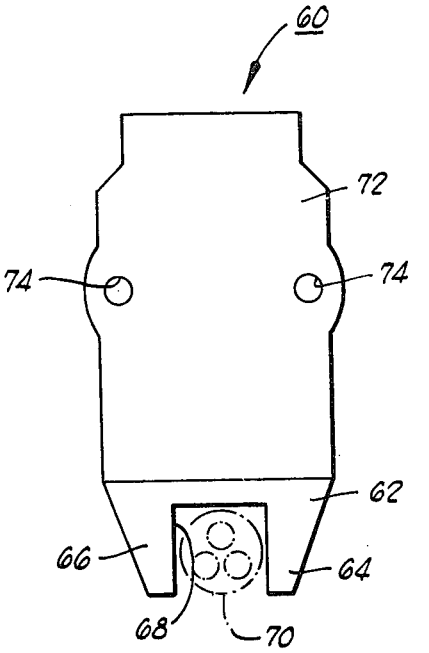
FIG. 5 is a plan view of an alternative form of guide shoe attachment.
Figure 6:
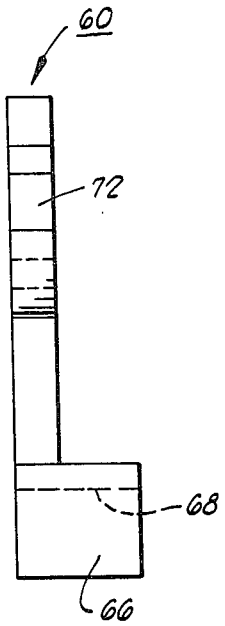
FIG. 6 is a side elevation of the guide shoe attachment as shown in FIG. 5.

FIGS. 5 and 6 illustrate an alternative form of guide attachment 60 which provides essentially the same guide characteristics of guide attachment 40 but includes a longitudinally elongated guide shoe 62 which defines the bifurcated guide points 64 and 66 and interior guide way 68 that receives cable 70 therein during stapling operation. An upper plate 72 may be formed of requisite thickness and configuration consonant with its mating surface whereby fastener holes 74 provide a mode of attachment as by screw fasteners or the like. The elongated guide shoe 66 serves to further insure that stapling gun 10 is in proper alignment over cable 70 prior to actuation and drive thrust placing the staple in its driven seat. The guide way 68 is of predetermined maximum width, the same as guide way 52 in FIG. 3, so that the driven staple cannot come in contact with the outer cable sheath of cable 70 during driven seating.

The foregoing discloses an attachment for use with existing stapling guns of the heavy duty type which are utilized in the construction industry. In particular, the stapling gun attachment enables rapid and accurate fastening of insulated electrical cable throughout a house or other building without danger of damage to the outer cable sheath which might precipitate moisture corrosion or other breakdown of the cable. Such guide attachments as disclosed herein may be shaped in various outer configurations which might best match the particular form of commercially available stapling gun utilized in attachment. In like manner, the securing holes may be varied in spacing, size or number for mating engagement with the existing frame fasteners of the stapling guns.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A workpiece guide attachment device for use in combination with a pneumatic stapling gun of the type which has a handle and driver head in association with an automatic wire staple magazine continually positioning staples for vertical drive thrust beneath the driver head and within a forward nose plate housing the vertical driving element, the attachment comprising:

plate means secured to said nose plate to extend bifurcated guide points below said nose plate, said bifurcated guide points defining a generally rectangular guide way for receiving the workpiece therein, said guide way being of a width slightly smaller than the inside width of said wire staples, said plate means being formed of a rigid material with the lower portion including said guide points of said guide attachment plate means being of materially thicker dimension than the upper plate portion thereof to provide a significantly elongated guide shoe defining said generally rectangular guide way receiving said workpiece; and means for fastening said plate means in rigid affixure to the nose plate.

* * * * *